US007421226B2

(12) United States Patent
Suenami et al.

(10) Patent No.: US 7,421,226 B2
(45) Date of Patent: Sep. 2, 2008

(54) DEVELOPING DEVICE AND IMAGE FORMING APPARATUS

(75) Inventors: Koji Suenami, Osaka (JP); Eiji Nimura, Osaka (JP); Hirohisa Endou, Osaka (JP); Hiroyuki Hamakawa, Osaka (JP); Yoshihiro Yamagishi, Osaka (JP)

(73) Assignee: Kyocera Mita Corporation (JP)

( * ) Notice: Subject to any disclaimer, the term of this patent is extended or adjusted under 35 U.S.C. 154(b) by 192 days.

(21) Appl. No.: 11/416,339

(22) Filed: May 2, 2006

(65) Prior Publication Data

US 2006/0257162 A1 Nov. 16, 2006

(30) Foreign Application Priority Data

May 11, 2005 (JP) ..... 2005-138001

(51) Int. Cl.
*G03G 15/08* (2006.01)

(52) U.S. Cl. ..... 399/104

(58) Field of Classification Search ..... 399/104, 399/267–278

See application file for complete search history.

(56) References Cited

U.S. PATENT DOCUMENTS 6,029,030 A * 2/2000 Yamaji et al. ..... 399/104
6,070,037 A * 5/2000 Sugihara et al. ..... 399/274

FOREIGN PATENT DOCUMENTS

JP 55093179 A * 7/1980
JP 10-48946 2/1998

* cited by examiner

*Primary Examiner*—Ryan Gleitz
(74) *Attorney, Agent, or Firm*—Gerald E. Hespos; Anthony J. Casella

(57) ABSTRACT

A developing device (50) includes a developing sleeve (53) for supplying toner particles (T) to a latent image area (22) on a peripheral surface of a photoconductive drum (20) while rotating about a central shaft (534). The developing sleeve (53) has an immovable sleeve magnet (533) therein. Two magnetic members (82) are disposed in opposite end portions of the developing sleeve (53) and are spaced a predetermined distance from the peripheral surface of the developing sleeve. Each magnet member (82) has an arc shape. A magnetic member magnet (83) is mounted in the magnet member (82) and faces a sleeve magnet (533) so that opposite facing portions of the magnetic member magnet (83) and the sleeve magnet (533) have the same polarity. With this construction, toner particles are prevented from leaking from the end portions of the developing sleeve (53).

16 Claims, 9 Drawing Sheets

DEVELOPING DEVICE AND IMAGE FORMING APPARATUS

BACKGROUND OF THE INVENTION

1. Field of the Invention

The present invention relates to a developing device in which toner particles are supplied to a static latent image formed on a peripheral surface of a photoconductive drum in an electrophotographic manner, and an image forming apparatus provided with the developing device.

2. Description of the Related Art

A predetermined developing device is used in an image forming apparatus which is operable to perform an electrophotographic manner. In the developing device, toner particles as a developer are supplied to a static latent image which is formed on a peripheral surface of a photoconductive drum in accordance with an image data. A toner image formed on the peripheral surface of the photoconductive drum by supplied toner particles as mentioned above is transferred onto a sheet which is an image bearing material conveyed from a sheet storage section with rotation of the photoconductive drum about an axis. A fixing device is provided on an immediately downstream of the photoconductive drum to perform a fixing process onto the sheet. A fixing process is conducted on the sheet onto which the toner image is transferred to fix the toner image on the sheet by heat. Then, the sheet is discharged to an outside after the completion of the fixing process.

The developing device includes stirring means for stirring a developer which includes only toner particles in the case of the one-component system, or a mixture of toner particles and carrier particles in the case of the two-component system, a cylindrical developing sleeve for supplying developer particles being stirred by the stirring means to the peripheral surface of the photoconductive drum, and a casing accommodating these members. In the case of the one-component system, toner particles supplied from a predetermined toner cartridge into the casing are stirred without adding an agent. In the case of the two-component system, toner particles are mixed and stirred with carrier particles put by a predetermined amount. Then, toner particles are supplied onto the peripheral surface of the photoconductive drum uniformly by a peripheral surface of the developing sleeve rotating about an axis. A blade is provided closely above the peripheral surface of the developing sleeve arranged along the peripheral surface of the photoconductive drum at a predetermined space. The blade removes surplus toner particles from the peripheral surface of the developing sleeve to thereby prevent excessive supply of toner particles to the photoconductive drum.

Meanwhile, there is the problem that when toner particles conveyed with the rotation of the developing sleeve reach the blade and some of the toner particles stray from a middle portion of the blade to the both ends of the blade, and disadvantageously leak from the respective end portions of the developing sleeve.

In order to solve this disadvantage, Japanese Unexamined Patent Publication No. HEI 10-48946 discloses that a half-ring shaped magnet is attached to each of the opposite side walls of the housing in a state of facing the end portion of the developing sleeve, and the magnet has a plurality of sets of opposite magnetic poles. The magnets are respectively disposed in the state of facing the peripheral surface of the both end portions of the developing sleeve to thereby produce a magnetic flux from one pole to the other pole of each set of magnetic poles, and the magnetic fluxes run in a space between an inner surface of the half-ring shaped magnet and the peripheral surface of the developing sleeve. Consequently, straying toner particles are prevented from leaking by the magnetic fluxes.

However, in the developing device disclosed in Japanese Unexamined Patent Publication No. HEI 10-48946, the magnetic fluxes merely run end to end of each set of magnetic poles in the space between the developing sleeve and the magnet. It will be seen that the magnet cannot effectively prevent straying toner particles from leaking. In particular, in machines aimed at performing image forming processing at a high speed, the developing sleeve is rotated at a high speed. Accordingly, toner particles have a greater inertial force. Thus, it is hard to prevent the toner leakage only by the end-to-end magnetic fluxes caused by the sets of magnetic poles provided on the magnet.

SUMMARY OF THE INVENTION

In view of the above problems, it is an object of the present invention to provide a developing device which can prevent toner particles from leaking from end portions of a developing sleeve more assuredly than a conventional manner, and an image forming apparatus provided with such developing device.

In order to achieve the object, a developing device according to an aspect of the present invention, includes a predetermined casing structure, a developing sleeve mounted in the casing for supplying toner particles to a latent image area on a peripheral surface of a photoconductive drum while rotating about an axis, the developing sleeve having an immovable sleeve magnet therein, a pair of magnetic members being disposed in the opposite end portions of the developing sleeve and spaced away from the peripheral surface of the developing sleeve a predetermined distance, each magnetic member having an arc shape, and a magnetic member magnet mounted in the magnetic member and facing the sleeve magnet in such a manner that the opposite facing portions of the magnetic member magnet and the sleeve magnet have the same polarity.

An image forming apparatus according to another aspect of the present invention is constructed so as to supply toner particles to a static latent image formed on a peripheral surface of a photoconductive drum and thereby form a toner image, and transfer the toner image onto a sheet. The image forming apparatus is provided with the above-mentioned developing device to form the toner image.

With this construction, when the developing sleeve is rotated about an axis in the state where toner particles is filled in the casing, toner particles are moved to the peripheral surface of the developing sleeve and supplied to the photoconductive drum by the rotation of the developing sleeve. Consequently, toner particles are supplied to the latent image area on the peripheral surface of the photoconductive drum rotating about an axis to thereby form a toner image. The toner image is transferred onto a sheet synchronously fed in response to the rotation of the photoconductive drum.

Due to the rotation of the developing sleeve, some toner particles are likely to receive a component force of moving the toner particles in directions which are orthogonal to the supplying direction and point to the both end portions of the developing sleeve. However, the magnetic member magnet is mounted in the magnetic member in such manner that the opposite facing portions of the magnetic member magnet and the sleeve magnet have the same polarity. Accordingly, magnetic fluxes from one magnetic pole repel the magnetic fluxes from the other magnetic pole in a space between the magnetic member magnet and the developing sleeve. Due to the magnetic fluxes repelling each other, straying toner particles are prevented from passing through the space, thereby being assuredly prevented from leaking from the both end portions of the developing sleeve.

As mentioned above, the magnetic member magnet is mounted in the magnetic member in such a manner that the opposite facing portions of the magnetic member magnet and the sleeve magnet have the same polarity. Accordingly, toner particles can assuredly be prevented from leaking from the both end portions of the developing sleeve in comparison with the case as a conventional manner where the magnetic fluxes are bridged between the adjacent opposite poles of each of a plurality of set of magnetic poles provided only on a magnetic member.

DETAILED DESCRIPTION OF THE PREFERRED EMBODIMENTS

Figure 1:
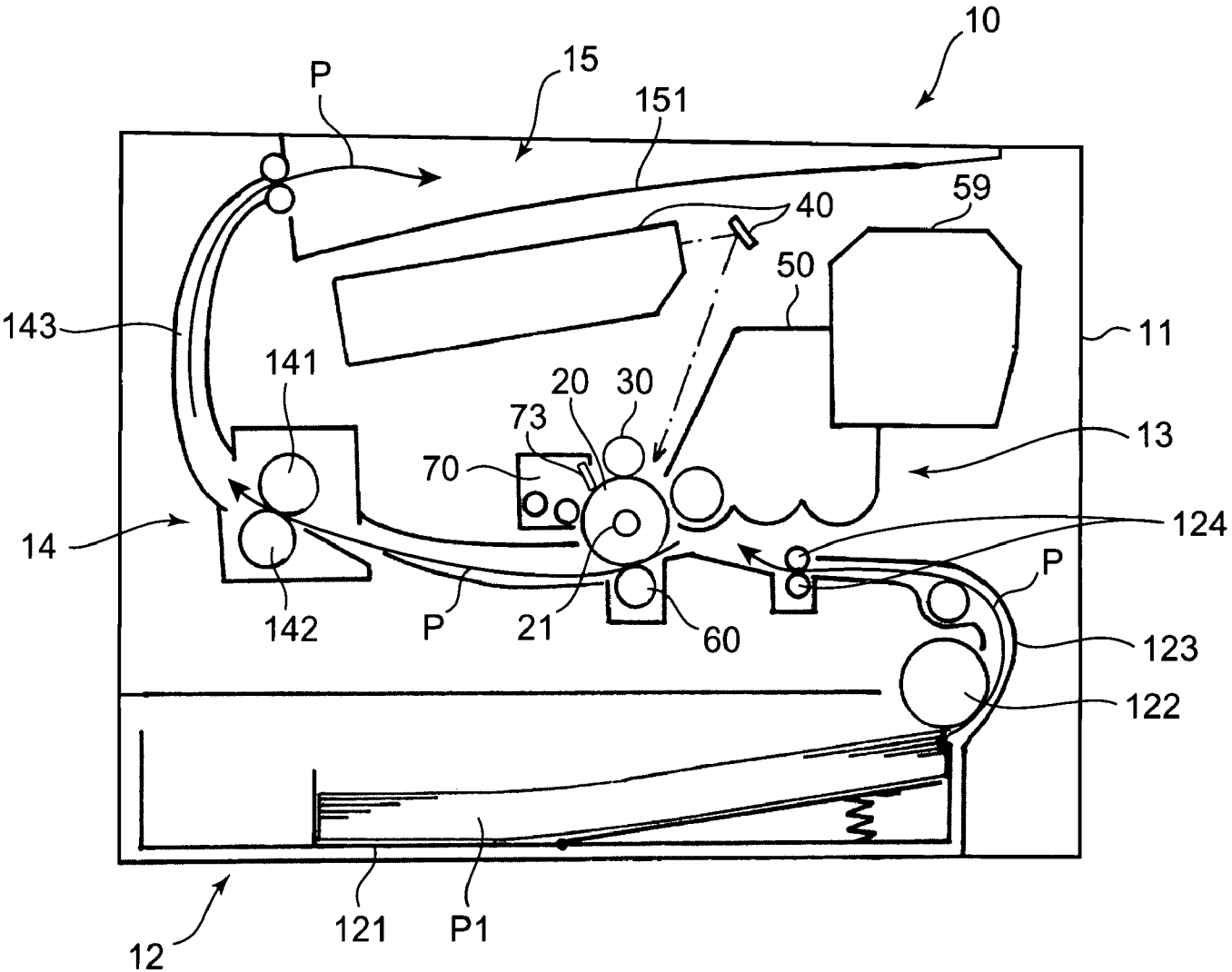
FIG. 1 is an explanatory sectional view showing a printer provided with a developing device according to an embodiment of the invention.

FIG. 1 is an explanatory sectional front view showing an embodiment of a printer employing a developing device according to an embodiment of the present invention. As shown in FIG. 1, the printer 10 (an image forming apparatus) includes a sheet storage section 12 for storing sheets P to be subjected to a printing process, an image forming section 13 for performing an image transferring process to a sheet P picked up one by one from the sheet storage section 12, a fixing section 14 for performing a fixing process to the sheet P after being subjected to the transferring process in the image forming section 13, and a housing 11 for accommodating these sections. The printer 10 further includes a discharge section 15 provided at a top of the housing 11 where the sheet P subjected to the fixing process in the fixing section 14 is discharged.

In the sheet storage section 12, a predetermined number of sheet cassettes 121 (one in the present embodiment) is detachably mounted in the housing 11. On an upstream of the sheet cassette 121 (right side in FIG. 1), a picking-up roller 122 is provided for picking a sheet P one by one from the sheet stack P1. The sheet P picked up by the picking-up roller 122 from the sheet cassette 121 is conveyed to the image forming section 13 through a sheet conveyance passage 123 and a pair of registration rollers 124 provided on a downstream end of the sheet conveyance passage 123.

In the image forming section 13, the transferring process is performed on the sheet P based on image information electrically transmitted from a computer and the like. The image forming section 13 is provided with a charging roller 30, an exposure device 40, a developing device 50, a transferring roller 60, and a cleaning device 70, which are disposed along a peripheral surface of a photoconductive drum 20 provided rotatably about a drum shaft 21 extending in a forward and backward direction (a direction orthogonal to a sheet surface of FIG. 1), in a clockwise direction from a position immediately above the photoconductive drum 20.

The photoconductive drum 20 is used for forming a static latent image on a peripheral surface thereof, and then forming a toner image along the static latent image. The photoconductive drum 20 is formed with an amorphous silicon layer laminated on the peripheral surface thereof. The photoconductive drum 20 is integrally supported by a drum shaft 21 extending in the forward and backward direction and has a common center as the drum shaft 21. The photoconductive drum 20 is rotated together with the drum shaft 21 due to a rotation of the drum shaft 21 in the clockwise direction driven by an un-illustrated driving means.

The charging roller 30 charges uniformly over the peripheral surface of the photoconductive drum 20 rotating in the clockwise direction about a drum axis in such a manner that a peripheral surface of the charging roller 30 comes into contact with the peripheral surface of the photoconductive drum 20 so as to charge the peripheral surface of the photoconductive drum 20 while being rotationally driven by the photoconductive drum 20. A corona discharge may be adopted instead of the charging roller 30. In the corona discharge system, the peripheral surface of the photoconductive drum 20 can be charged by a corona discharge from a wire.

In the exposure device 40, a laser beam having an intensity varied based on an image data electrically transmitted from an external apparatus such as computer is irradiated on the peripheral surface of the photoconductive drum 20, and the electric charge is removed from the portion to which the laser beam is irradiated, and the static latent image is consequently formed on the surface.

In the developing device 50, toner particles T used as a developer is supplied on the peripheral surface of the photoconductive drum 20 so as to be adhered to the portion where the static latent image is formed. Thus, a toner image is formed on the peripheral surface of the photoconductive drum 20. In the present embodiment, a developer of one-component system consisting of toner particles T is employed. However, the developer of the present invention is not limited to the developer of one-component system. A developer of two-component system consisting of toner particles T and carrier may be used.

Toner particle T is a particle having a diameter of 6 to 12 μm, and including an additive agent such as color agent, charge control agent, and wax, these agent being dispersed in a binder resin. Meanwhile, the carrier is a magnetic particle such as magnetic iron ore ($Fe_3O_4$) having a diameter of 60 to 200 μm, and used for charging toner particles T. Toner particles T are a wasteful item necessary to be appropriately replenished from a toner cartridge 59 to the developing device 50. The carrier is put by a predetermined amount in the developing device 50, and generally used continuously without being consumed (In the present embodiment, no carrier is put in the developing device 50).

The transferring roller 60 is operable to transfer the positively charged toner image formed on the peripheral surface of the photoconductive drum 20 onto the sheet P fed to a position immediately beneath the photoconductive drum 20.

The transferring roller 60 gives the sheet P negative charge which has the opposite polarity to the electric charge of the toner image.

The sheet P passing immediately beneath the photoconductive drum 20 is pressedly moved between the transferring roller 60 and the photoconductive drum 20, and the positively charged toner image on the peripheral surface of the photoconductive drum 20 is peeled off toward the negatively charged surface of the sheet P. In this manner, the transferring process is performed on the sheet P.

In the cleaning device 70, the photoconductive drum 20 after the completion of the transferring process is cleaned by removing toner particles T remaining on the peripheral surface of the photoconductive drum 20. The peripheral surface of the photoconductive drum, which is cleaned by the cleaning device 70, is advanced to the charging roller 30 again for operating the next image forming process.

In the fixing section 14, the fixing process is performed by heating the toner image on the sheet P to which the transferring process is performed in the image forming section 13. The fixing section 14 interiorly includes a heating roller 141 having an energized heating element, such as a halogen lamp and a pressing roller 142 disposed below the heating roller 141 in such a manner that the peripheral surface of the pressing roller 142 and the peripheral surface of the heating roller 141 face with each other. The sheet P after the completion of the transferring process is passed through a nip area between the heating roller 141 rotating in the clockwise direction about a roller shaft and the pressing roller 142 rotated along with the rotation of the heating roller 141 in a counterclockwise direction so as to be subjected to the fixing process by being heated by the heating roller 141. The sheet P after the completion of the fixing process is discharged to the discharge section 15 through a conveyance passage 143.

The discharge section 15 is defined by a concaved top of the housing 11, and provided with a discharge tray 151 for receiving the sheet P discharged on a bottom of the concaved portion.

Figure 2:
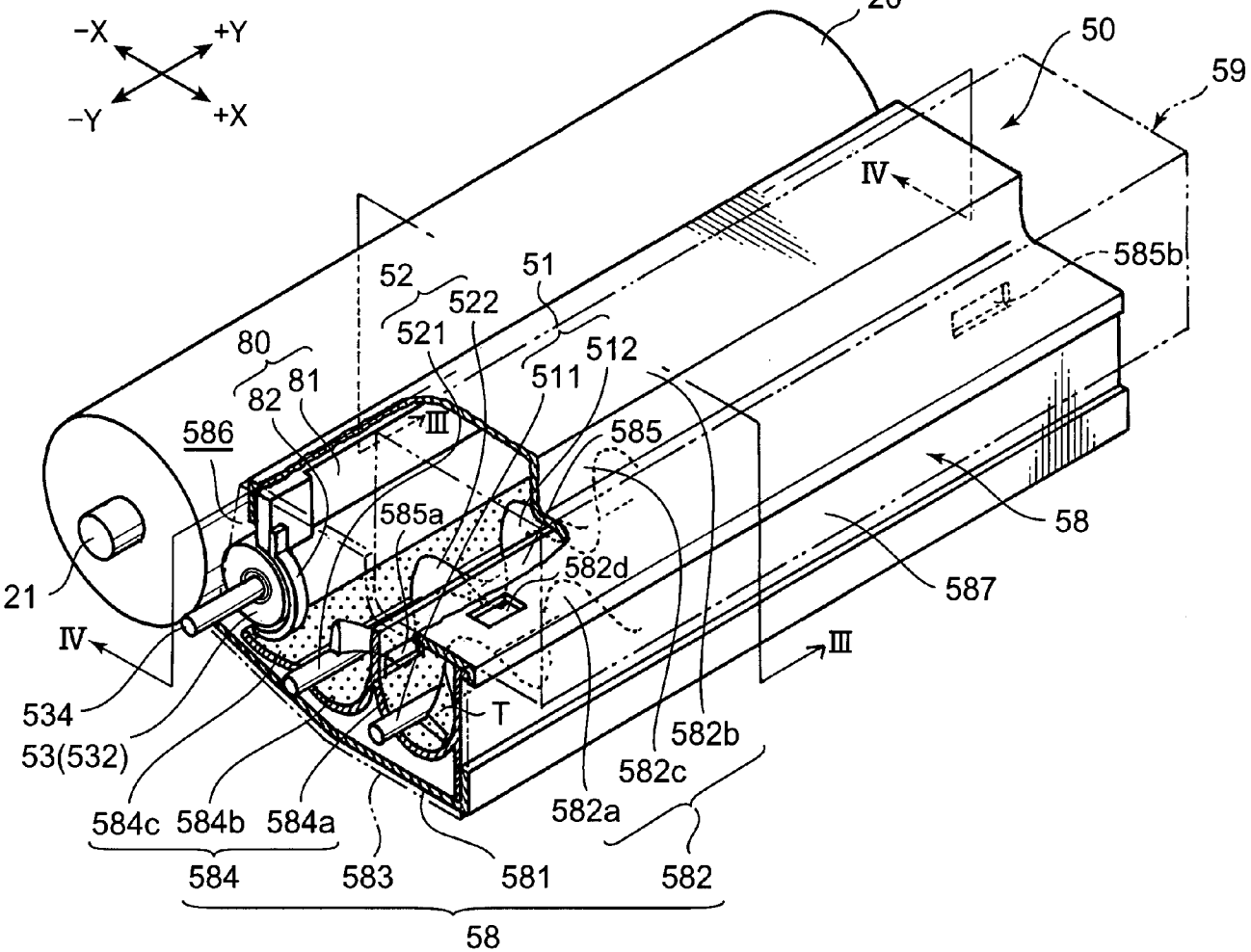
FIG. 2 is a partially cut-away perspective view showing a construction of the developing device.
Figure 3:
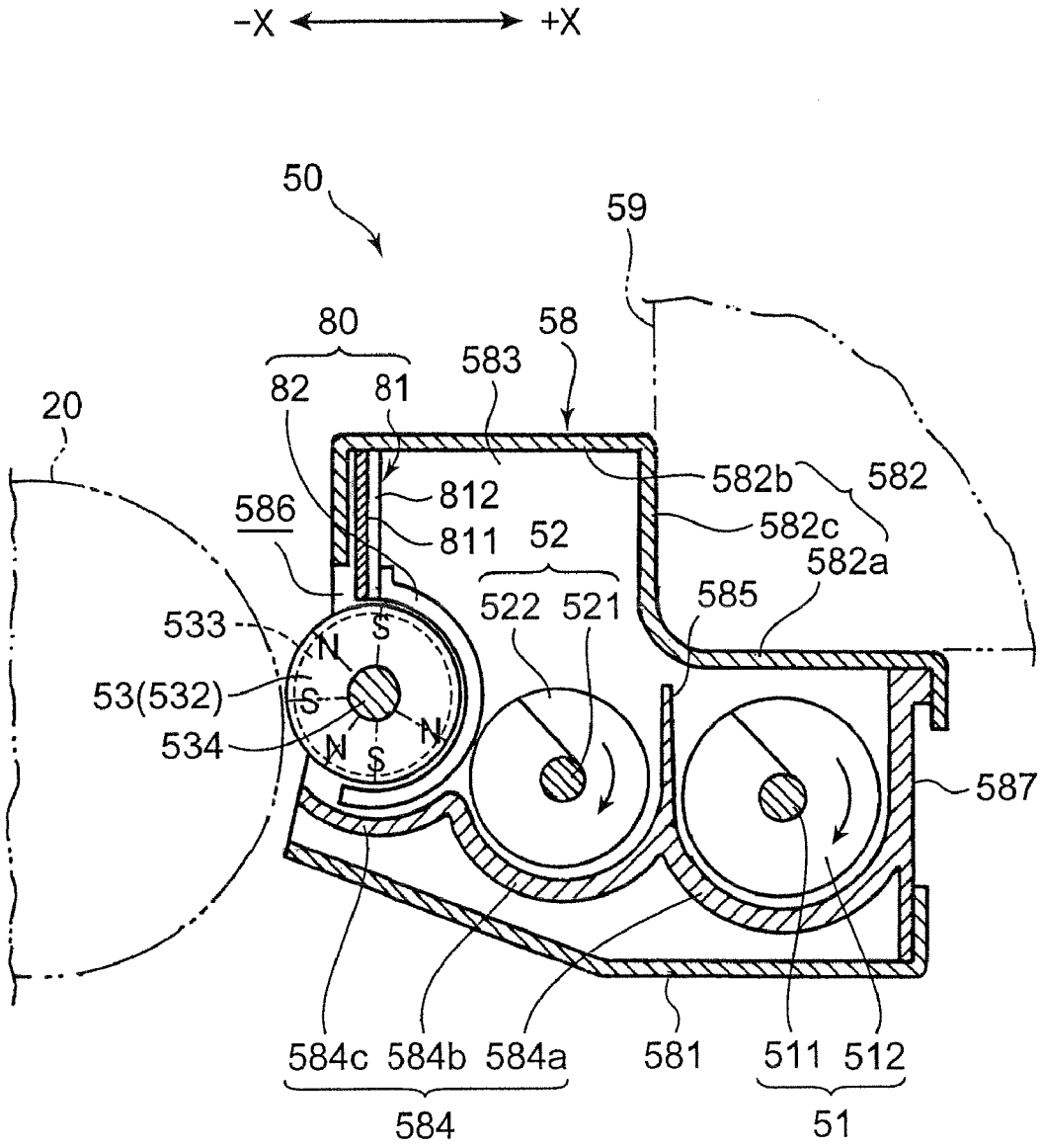
FIG. 3 is a cross sectional view taken along the line III-III in FIG. 2.
Figure 4:
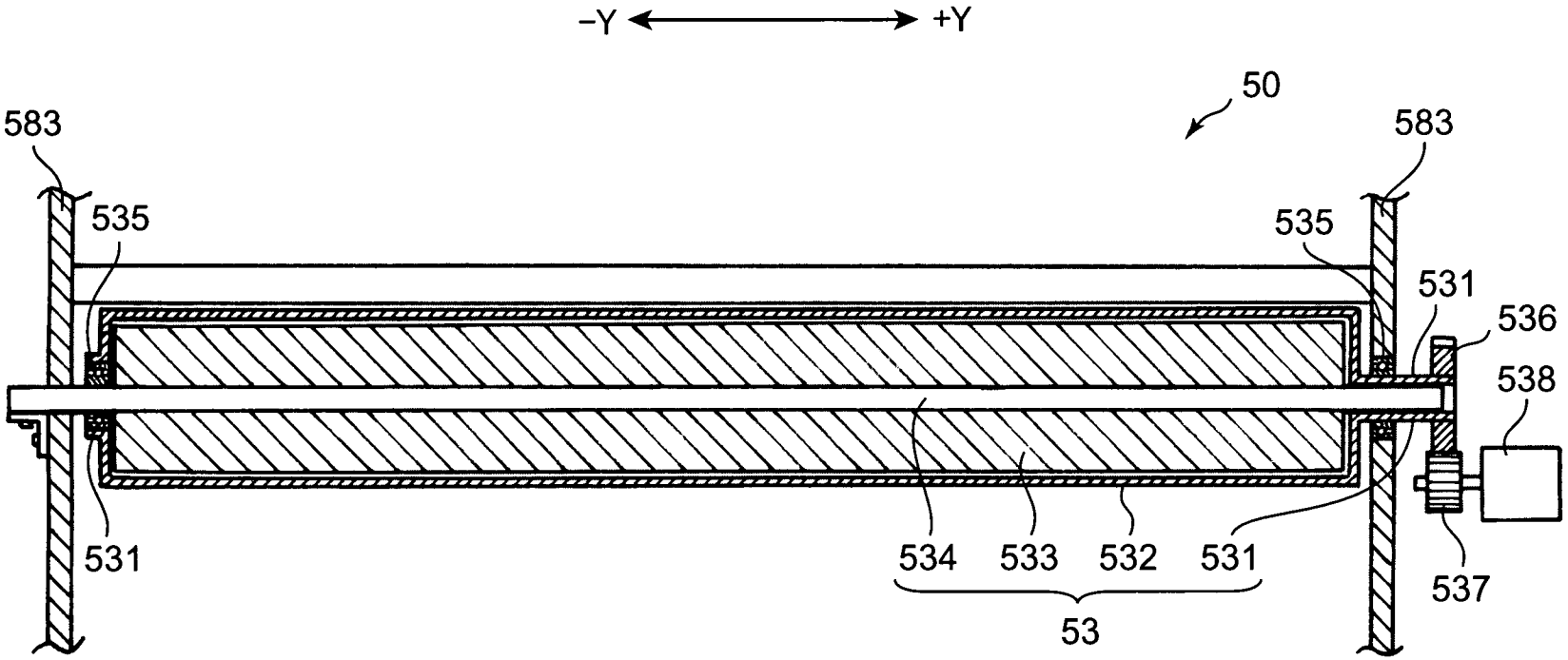
FIG. 4 is a cross sectional view taken along the line IV-IV in FIG. 2.

FIG. 2 is a partially cut-away perspective view showing a construction of the developing device 50. FIG. 3 is a cross sectional view taken along the line III-III in FIG. 2. FIG. 4 is a cross sectional view taken along the line IV-IV in FIG. 2. In FIGS. 2 to 4, X-X indicates a leftward and rightward direction, and Y-Y indicates a forward and backward direction. Specifically, −X, +X, −Y, and +Y directions indicate the leftward, rightward, frontward and backward directions, respectively. As shown in FIG. 2, the developing device 50 includes a first spiral feeder 51 for feeding toner particles replenished from the toner cartridge 59 backward while stirring toner particles, a second spiral feeder 52 for feeding toner particles received from the first spiral feeder 51 forward, and a developing sleeve 53 for receiving toner particles T being fed by the second spiral feeder 52 and feeding toner particles T to the latent image area on the peripheral surface of the photoconductive drum 20, in such a manner that the first spiral feeder 51, the second spiral feeder 52, and the developing sleeve 53 are mounted in a heteromorphic box-shaped casing 58.

As shown in FIGS. 2 and 3, the casing 58 is L-shaped in a front view from the −Y direction (FIG. 2). The casing 58 includes a bottom plate 581 extending from a substantially center portion in the leftward and rightward direction to the photoconductive drum 20 in such a manner that the left portion of the bottom plate 581 extends upwardly and a left end portion thereof faces the photoconductive drum 20, a top plate 582 disposed in an upside in an opposite relation to the bottom plate 581, a pair of side plates 583 formed between end portions in the forward and backward direction of the bottom plate 581 and the top plate 582 (a side plate in the forward direction is shown by a two-dot chain line in FIG. 2.), and a toner receiving tray 584 formed between the pair of side plates 583.

The top plate 582 is formed in a stepwise-shape having a left portion higher by one step, and includes a lower top plate 582*a* in the right side, a higher top plate 582*b* in the left side, and a vertical top plate 582*c* formed between a left end of the lower top plate 582*a* and a right end of the higher top plate 582*b*. A toner receptive opening 582*d* for receiving toner particles from the toner cartridge 59 is provided in a front end portion of the lower top plate 582*a*. A toner supply opening 586 for supplying toner particles T in the casing 58 to the peripheral surface of the photoconductive drum 20 is provided in an opposite relation to the peripheral surface of the photoconductive drum 20 between a left end of the higher top plate 582*b* and a left end of the bottom plate 581.

The toner receiving tray 584 is provided with a first tray 584*a* for accommodating the first spiral feeder 51, a second tray 584*b* for accommodating the second spiral feeder 52, a third tray 584*c* disposed in opposite relation to the developing sleeve 53 in the lower portion. Each of the first to third trays 584*a*, 584*b*, and 584*c* is formed in an arc shape from a front view for accommodating the first and second spiral feeder 51 and 52, and the developing sleeve 53, respectively. Further, a right side wall 587 is formed in a right end portion of the first tray 584*a*, and the right side wall 587 is also formed between the respective right ends of the bottom plate 581 and the lower top plate 582*a*, thereby closing a right side of the casing 58.

The first spiral feeder 51 includes a first feeder shaft 511 penetrating between the pair of the side walls 583 immediately above the first tray 584*a*, and a first spiral fin 512 fixedly attached to the first feeder shaft 511 and having a common center as the first feeder shaft 511. The first spiral fin 512 is formed in a left hand thread spiral manner. The first feeder shaft 511 is rotated in the clockwise direction in a front view, accordingly, toner particles T on the first tray 584*a* are fed backward.

The second spiral feeder 52 includes a second feeder shaft 521 penetrating between the pair of side plates 583 immediately above the second tray 584*b*, and a second spiral fin 522 fixedly attached to the second feeder shaft 521 and having a common center as the second spiral fin 522. The second spiral fin 522 is formed in a right hand thread spiral manner. The second feeder shaft 521 is rotated in the clockwise direction in a front view, accordingly toner particles T on the second tray 584*b* are fed forward.

A dividing wall 585 is formed between the first and second trays 584*a* and 584*b*. A forward distribution opening 585*a* is provided in the forward portion of the dividing wall 585, and a backward distribution opening 585*b* is provided in the backward portion thereof. Toner particles T fed in the casing 58 from the toner cartridge 59 through the toner receptive opening 582*d* are fed backward by the rotation of the first spiral feeder 51 in the first tray 584*a*, and fed in the second tray 584*b* through the backward distribution opening 585*b*, and then, fed forward by the rotation of the second spiral feeder 52 in the second tray 584*b*. Hereafter, a part of toner particles are supplied to the developing sleeve 53 while circulating between the first and second tray 584*a* and 584*b*.

As shown in FIG. 4, the developing sleeve 53 includes a pair of sleeve shaft tubes 531 on both ends of the forward and backward direction in which the sleeve shaft tube 531 in the backward end portion penetrates through one of the side walls 583, a sleeve main body 532 formed integrally with the pair of the sleeve shaft tubes 531 so as to have a hollow inside thereof and having a common axis as the pair of the sleeve shaft tubes 531, a cylindrical sleeve magnet 533 mounted in the sleeve main body 532 and having a common axis as the sleeve main body 532. The central shaft 534 is coaxially passed through the sleeve magnet 533. The both ends of the central shaft 534 project outward from the both ends of the sleeve magnet 533. A backward portion of the central shaft 534 penetrates through the backward side plate 583 with being enclosed in the backward sleeve shaft tube 531 while a forward portion of the central shaft 534 is fixedly attached to the side plate 583 with penetrating the forward sleeve shaft 531 and the forward side plate 583 serially. With this construction, the sleeve magnet 533 is immovable, i.e., the sleeve magnet 533 cannot be rotated.

A bearing 535 is intermediately provided between the sleeve shaft tube 531 and the backward side plate 583, and the bearing 535 is intermediately provided between the forward central shaft 534 and the forward sleeve shaft tube 531. Consequently, the sleeve main body 532 is supported rotatably about the central shaft 534.

In the developing sleeve 53, a portion projecting outward from the side plate 583 of the backward sleeve shaft tube 531 is integrally engaged with a driven gear 536 with having a common center as the driven gear 536, and a driving motor 538 is provided in the vicinity of the driven gear 536. A driving gear 537 with which a driving shaft of the driving motor 538 is integrally engaged so as to have a common center as the driving gear 537 is engaged with the driven gear 536. Accordingly, in the case where the driving motor 538 is driven, the rotation of the driven motor 538 is transmitted to the sleeve shaft tube 531 via the driving gear 537 and the driven gear 536 so that the sleeve main body 532 is rotated about the central shaft 534.

The developing sleeve 53 is installed above the third tray 584*c* in such a manner that the peripheral surface of the sleeve main body 532 faces the peripheral surface of the photoconductive drum 20 through the toner supply opening 586. Further, the driving of the driving motor 538 causes the developing sleeve 53 to rotate about the central shaft 534 in the counterclockwise direction in FIG. 3. Consequently, toner particles T fed on the third tray 584*c* are allowed to forward the peripheral surface of the photoconductive drum 20.

Figure 5:
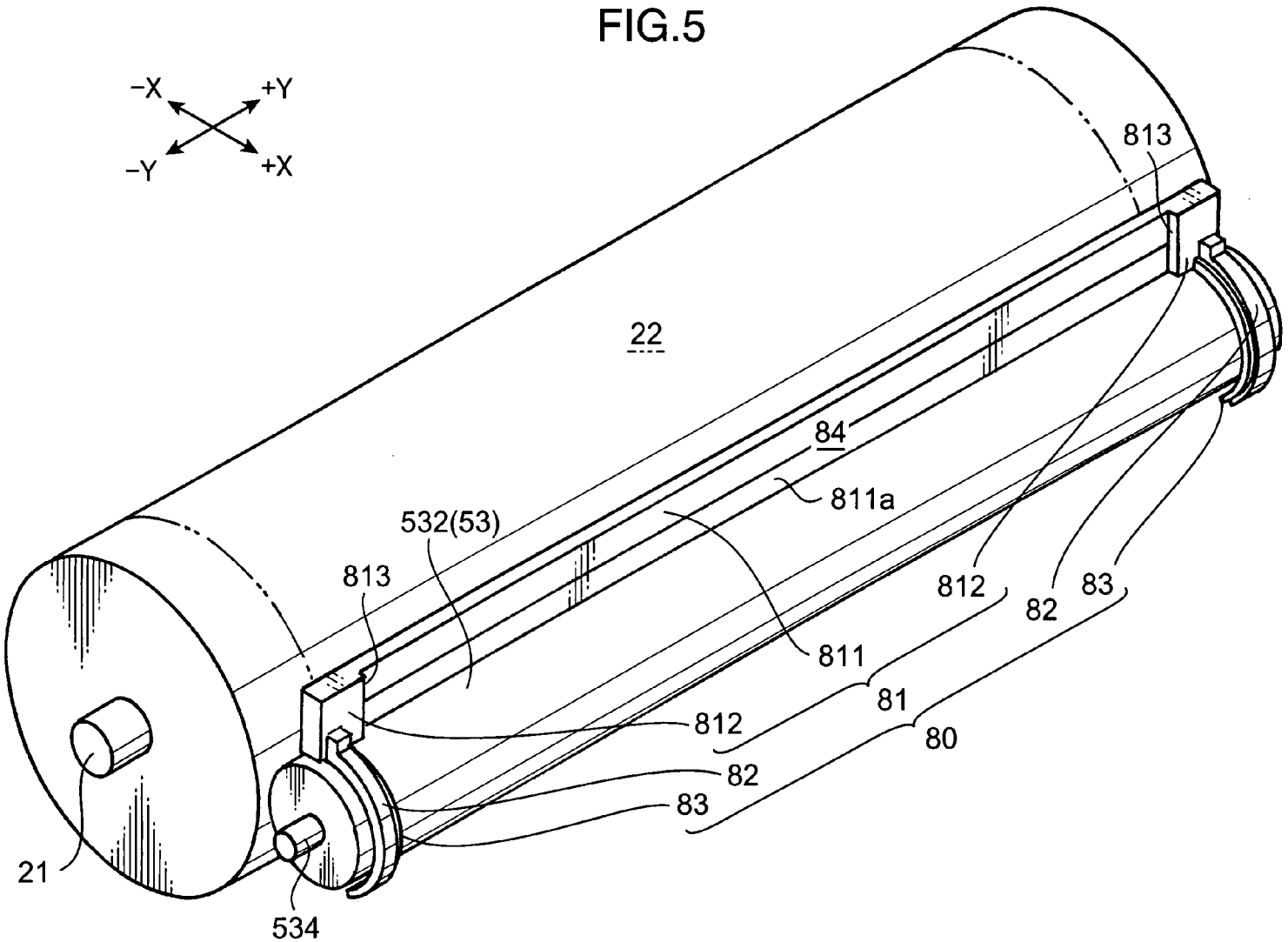
FIG. 5 is a perspective view showing a toner leakage preventing structure.
Figure 6:
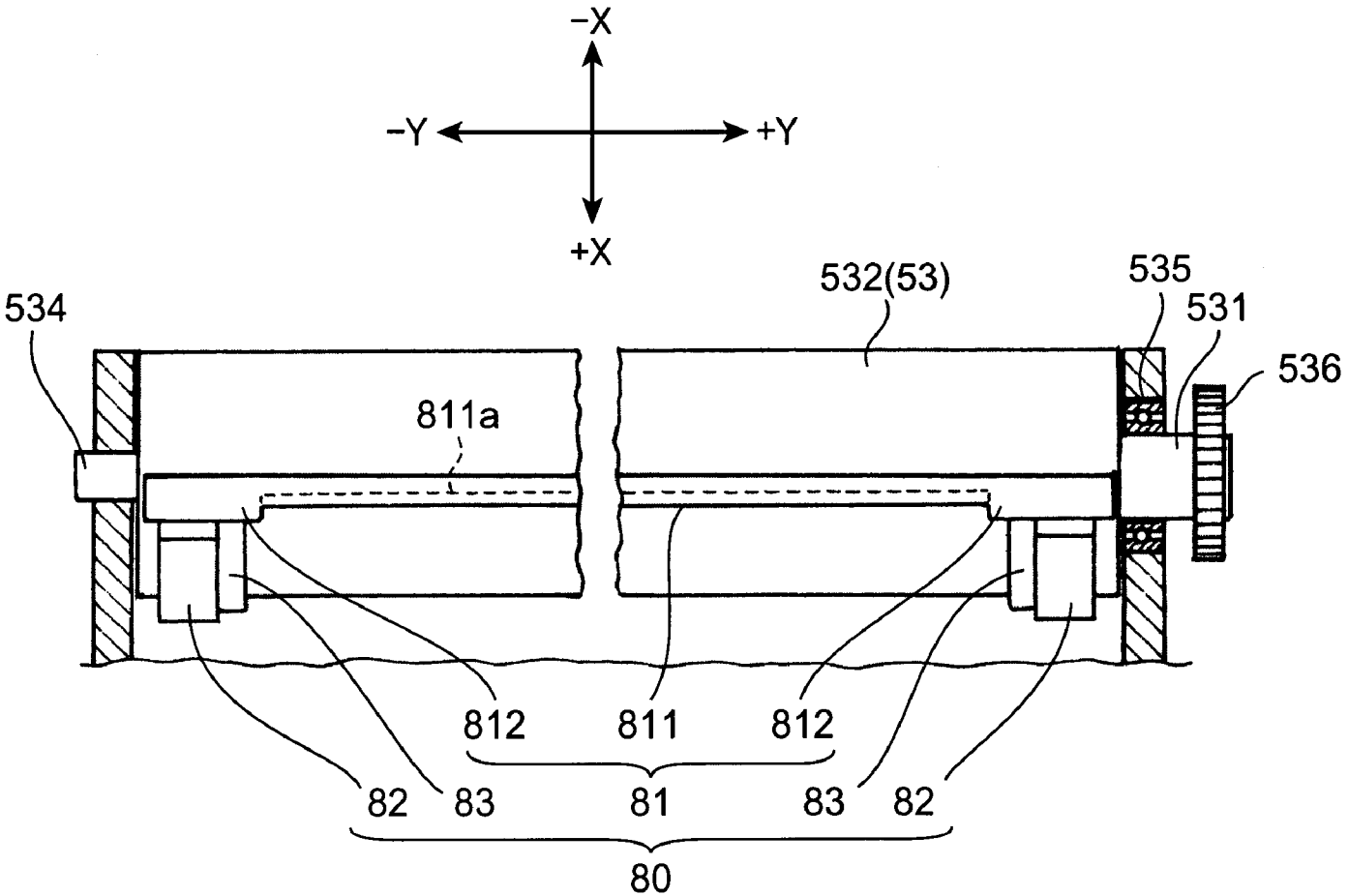
FIG. 6 is an explanatory plan view showing the toner leakage preventing structure shown in FIG. 5.
Figure 7:
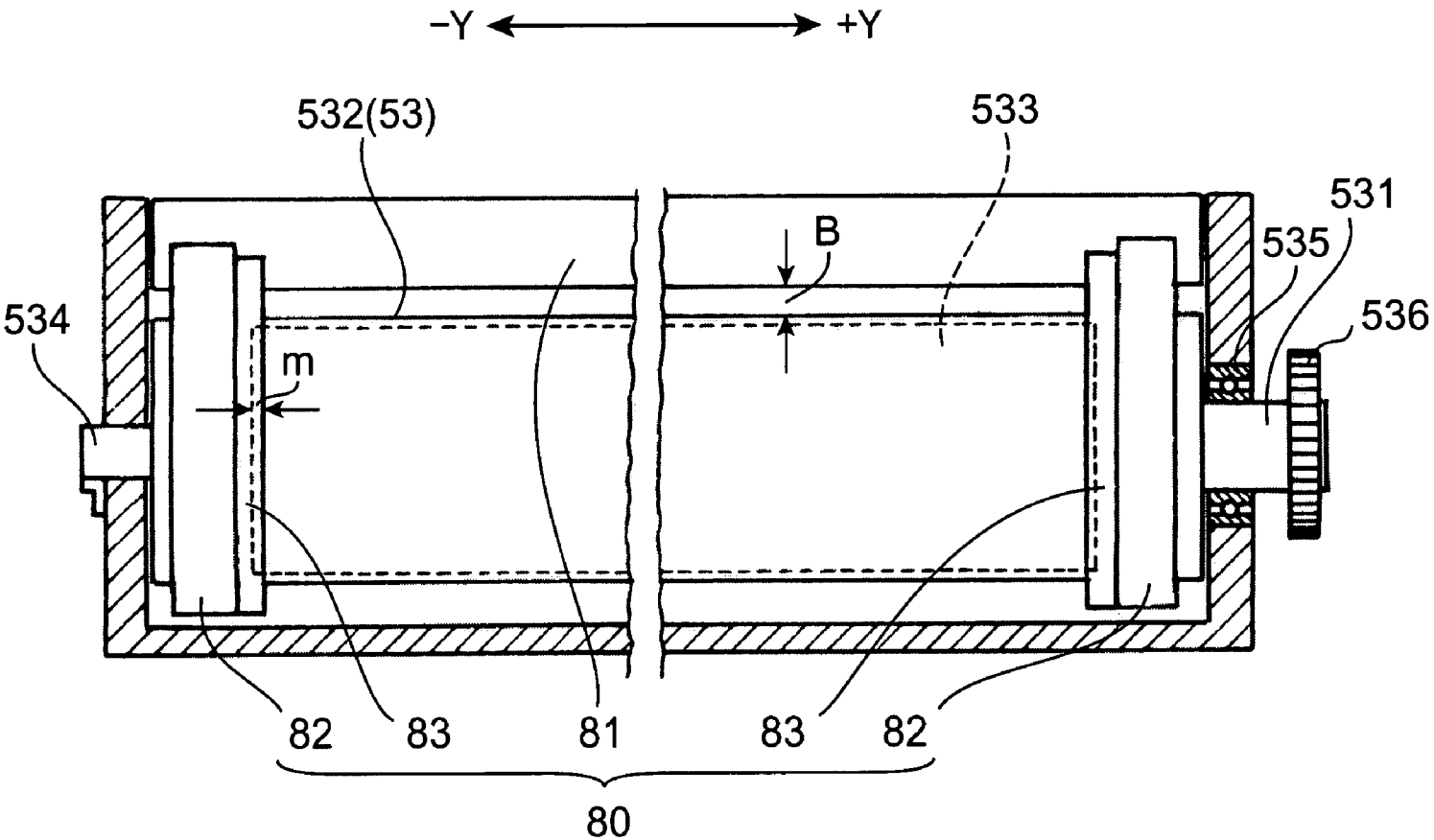
FIG. 7 is an explanatory side view showing the toner leakage preventing structure shown in FIG. 5.
Figure 8:
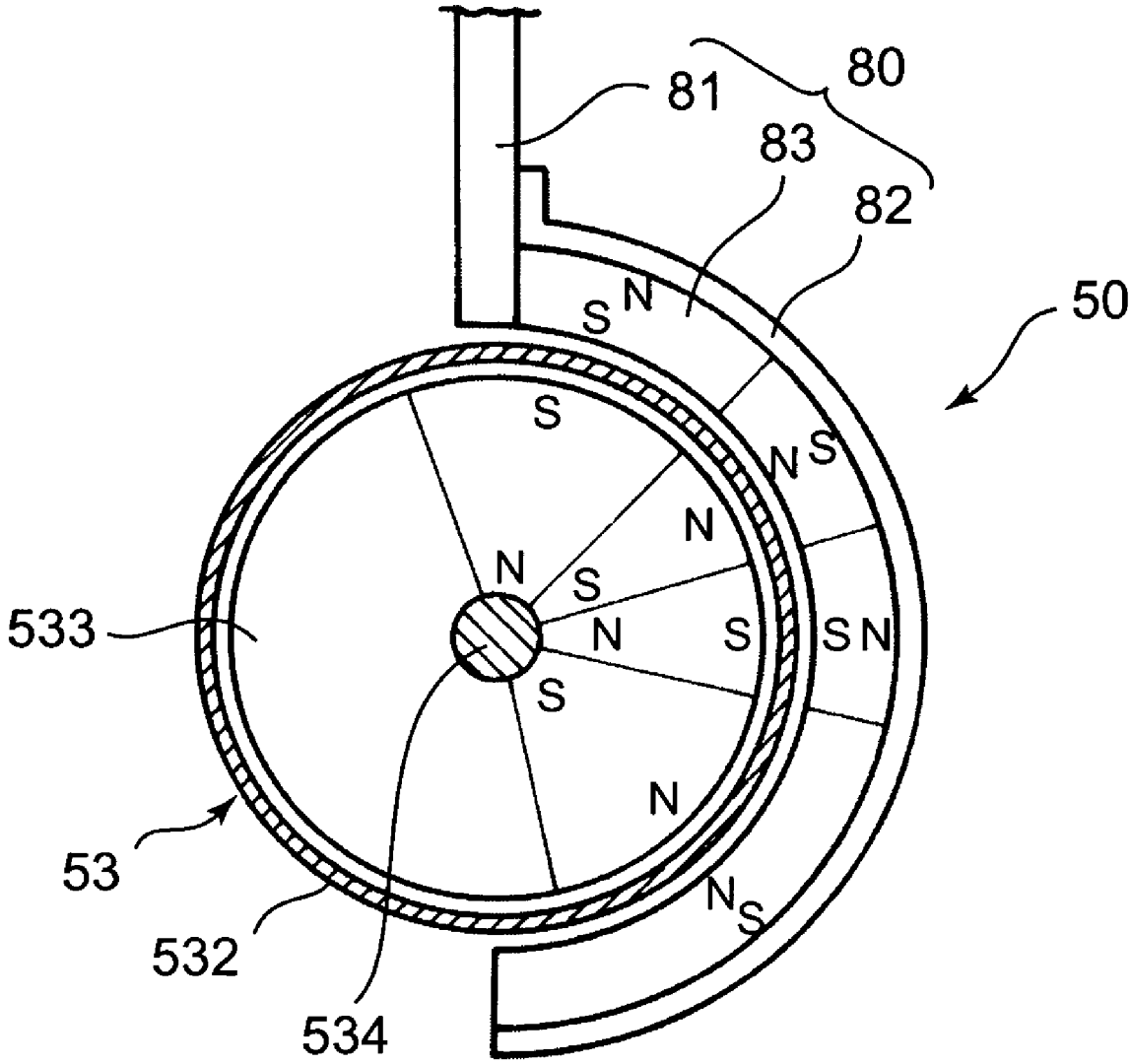
FIG. 8 is an explanatory front view showing the toner leakage preventing structure shown in FIG. 5.

In the present embodiment, the developing device 50 constructed as above is provided with a toner leakage preventing structure 80 in which toner particles T are appropriately supplied to the photoconductive drum 20 and prevented to leak from an end portion of the sleeve main body 532. FIG. 5 is a perspective view showing the toner leakage preventing structure 80. FIG. 6 is an explanatory plan view showing the toner leakage preventing structure 80 shown in FIG. 5. FIG. 7 is an explanatory side view of the toner leakage preventing structure 80. FIG. 8 is an explanatory plan view of the toner leakage preventing structure 80. Directions indicated by references X and Y in FIGS. 5 to 8 are the same as those in FIG. 2 (The reference X indicates the leftward and rightward direction in such a manner that the −X indicates the leftward, and the +X indicates the rightward. The reference Y indicates the forward and backward direction in such a manner that the −Y indicates the forward, and the +Y indicates the backward.). Hereinafter, the toner leakage preventing structure 80 is described referring to FIGS. 5 to 8, and FIGS. 1 to 3 as appropriately.

As shown in FIG. 5, the toner leakage preventing structure or assembly 80 includes a blade 81 drooping from a left end portion of the higher top plate 582*b* to a peripheral surface of the sleeve main body 532 and extending in the forward and backward direction, a pair of magnetic members 82 disposed in the opposite ends of the sleeve main body 532 in a right side of the sleeve main body 532, and a magnetic member magnet 83 mounted on the magnet member 82.

The blade 81 is employed for controlling the amount of toner particles T supplied to a latent image area 22 (an area defined between the two-dot chain line shown in FIG. 5, where the static latent image is formed) on the peripheral surface of the photoconductive drum 20 by a rotation of the developing sleeve 53 about the sleeve shaft tube 531 so as to prevent toner particles T from being supplied excessively. A gap B having a gap size of 0.1 mm to 0.5 mm is provided between a bottom end of the blade 81 and the peripheral surface of the developing sleeve 53 (see FIG. 7). In the case where the gap B is less than 0.1 mm, the gap is too narrow to appropriately supply toner particles T to the peripheral surface of the photoconductive drum 20, therefore, a toner image having an appropriate density is hard to be formed. On the other hand, in the case where the gap is above 0.5 mm, toner particles T are excessively supplied to the photoconductive drum 20. Therefore, an excessively dark toner image is apt to be formed on the latent image area 22 of the photoconductive drum 20.

The blade 81 includes a thin portion 811 facing the latent image area 22 in the center of the longitudinal direction, and a pair of thick portions 812 on the opposite end portions. The thick portion 812 projects rightward from the thin portion 811 at the both end portions of the blade 81 (in other words, the thick portion 812 projects inward of the casing 58 shown in FIG. 2.). Step portions 813 are formed at the respective boundaries between the thin portion 811 and the thick portion 812.

The step portion 813 is formed to prevent toner particles T from leaking from the end portion of the sleeve main body 532 when toner particles T guided to the peripheral surface of the developing sleeve 53 due to the rotation thereof and forwarded to the photoconductive drum 20 hit the blade 81, and toner particles T partially move outward in the longitudinal direction. In other words, though toner particles T hitting the thin portion 811 of the blade 81 moves in the forward and backward direction, since the step portions 813 are formed on the opposite end portions of the thin portion 811, the movement of toner particles T in the forward and backward direction are controlled by the step portions 813 to move upwardly. Therefore, toner particles T are prevented from leaking from the end portion of the sleeve main body 532.

The vertical dimension of the blade 81 is set at substantially 25 mm depending on the local conditions in the present embodiment. According to the invention, however, the vertical dimension of the blade 81 is not limited to 25 mm, and the dimension can be appropriately set according to a situation, such as a design condition and the like. Further, a thickness of the thick portion 812 (FIG. 6) is thicker than the thin portion 811 within a range of a half to twice of the thickness t of the thin portion 811 (In the present embodiment, the thickness t of the thin portion 811 is 2.0 mm).

The reason why such range is set is as follows. In the case where the step portion 813 is smaller than half of the thickness t of the thin portion 811 ($t \times 1/2$), the step is too small to control the movement of toner particles T in the lateral direction. On the other hand, in the case where the step portion 813 is above twice of the thickness t of the thin portion 811 ($t \times 2$), it is difficult to dispose the thick portion 812 at an appropriate portion due to the size.

The thickness of the thick portion 812 (FIG. 6) is not limited to the thickness thicker than the thin portion 811 by half to twice of the thickness t of the thin portion 811. An optimal value may be appropriately set according to the situations, such as a design or size condition.

In the present embodiment, the blade 81 is made of a magnetic material to cause magnetic fluxes of a sleeve magnet 533 (FIG. 7) interiorly placed in the sleeve main body 532 to pass the blade 81, and bring about a short magnetic field in the gap between the end edge of the blade 81 and the peripheral surface of the sleeve main body 532. In this manner, toner particles T are properly supplied to the photoconductive drum 20 by the short magnetic field.

In addition to the above, in the present embodiment, a blade magnet 811*a* is fitted on a substantially lower half of the thin portion. The blade magnet 811*a* is placed on the notch portion extending entire length of the thin portion 811 that is formed in the substantially lower half of the thin portion 811. With this construction, a right surface of the thin portion 811 is flush with the blade magnet 811*a*. The blade magnet 811*a* so constructed allows the magnetic fluxes to be bridged between the blade magnet 811*a* and the sleeve magnet 533 fitted in the sleeve main body 532 so as to produce the short magnetic field by which toner particles T are supplied to the peripheral surface of the photoconductive drum 20 more assuredly.

The magnetic member 82 is adapted to prevent toner particles T from moving toward the ends of the peripheral surface of the sleeve main body 532 with which toner particles T come into contact until toner particles T reach the blade 81 in the upper portion of the third tray 584*c* in the casing 58. The magnetic member 82 is formed into an arc shape whose center angle is substantially 180°. As shown in FIG. 8, an upper end of the magnetic member 82 is fixedly attached to the thick portion 812 of the blade 81, and a lower end of the magnetic member 82 is disposed in opposite relation to the third tray 584*c* of the casing 58. With this construction, it is ensured to mount the magnetic member 82 to be spaced away from the sleeve main body 532. In the present embodiment, a width of the magnetic member 82 in the forward and backward direction is substantially 4 mm.

According to the magnetic member 82 constructed as above, the magnetic brush by the magnetic fluxes is formed between the magnetic member 82 and the sleeve magnet 533 interiorly disposed in the sleeve main body 532 so as to control the movement of toner particles T, thereby effectively preventing the movement of toner particles T on the peripheral surface of the sleeve main body 532 toward the end portion thereof.

The magnetic member 82 constructed as above has an inner diameter larger by 0.1 mm to 0.5 mm than an outer diameter of the sleeve main body 532. The reason why such range is set is as follows. In the case where a difference between the inner diameter of the magnetic member 82 and the outer diameter of the sleeve main body 532 is less than 0.1 mm, the space is so narrow that the peripheral surface of the sleeve main body 532 possibly comes into contact with the inner surface of the magnetic member 82. On the other hand, in the case where the difference is above 0.5 mm, toner particles T cannot be assuredly prevented from leaking by the magnetized brush.

In the present invention, the magnetic member magnet 83 is fitted in the magnetic member 82 so that magnetic fluxes are formed between the magnetic member magnet 83 and the sleeve magnet 533, therefore toner particles T are prevented more assuredly from leaking from the sleeve main body 532 by the magnetic fluxes. As shown in FIG. 8, the magnetic member magnet 83 has the outer diameter equal to the inner diameter of the magnetic member 82, and is made of a member having the thickness of substantially 1 mm, and whose inner diameter is slightly smaller than that of the magnetic member 82. The magnetic member magnets 83 are fitted by an adhesive and the like at the respective inner surfaces of the pair of magnetic members 82, and the each magnetic member magnet 83 has a center common to that of the magnetic member 82.

The magnetic member magnet 83 includes a plurality of magnet units aligned side by side. Meanwhile, the sleeve magnet 533 includes magnet units, each of which having the shape of a donut sector in a front view and extending in the forward and backward direction. Each magnet unit of the magnetic member magnet 83 is so mounted to face each magnet unit of the sleeve magnet 533 in such manner that the same polarities of the magnet unit of the magnetic member magnet 83 and the magnet unit of the sleeve magnet 533 face each other.

As shown in FIG. 8, in the present embodiment, four pairs of magnet units facing each other between the magnetic member magnet 83 and the sleeve magnet 533 are used. A top magnet unit of the magnetic member magnet 83 and an opposite magnet unit of the sleeve magnet 533 have the south pole. From the top pole, the opposite facing magnet units have the north pole, the south pole, and the north pole in the clockwise direction. The opposite facing magnet units each have boundaries, and the boundaries of the opposite facing magnet units are substantially aligned with one another, as shown clearly in FIG. 8. However, the number of the pair of the opposite magnet units of the present invention is not limited to four. Three pairs and below or four pairs or more may be used depending on the situation.

The dimension in the circumferential direction of each magnet unit is appropriately set depending on the situation. In the present embodiment, the circumferential dimensions of the top and the bottom magnet units are longer than those of other magnet units disposed between the top and the bottom magnet units.

As shown in FIG. 7, an inner end portion of the magnet member magnet 83 is slightly overlapped with an end portion of the sleeve magnet 533 in the forward and backward direction in the sleeve main body 532 (the leftward and rightward direction on a sheet of FIG. 7). In the present embodiment, the amount of the overlapped portion is 0.5 mm. However, the overlapped amount is not limited to 0.5 mm, and appropriately set depending on the situation. The reason why such overlapping amount m is set is as follows. In the case where the magnetic brush from the sleeve magnet 533 is straightly formed in radial directions of the sleeve magnet 533, the maximum magnetic force effect of the magnetic brush can be obtained. Accordingly, toner particles T can be effectively prevented from moving toward the end portions of the sleeve main body 532.

Figure 9:
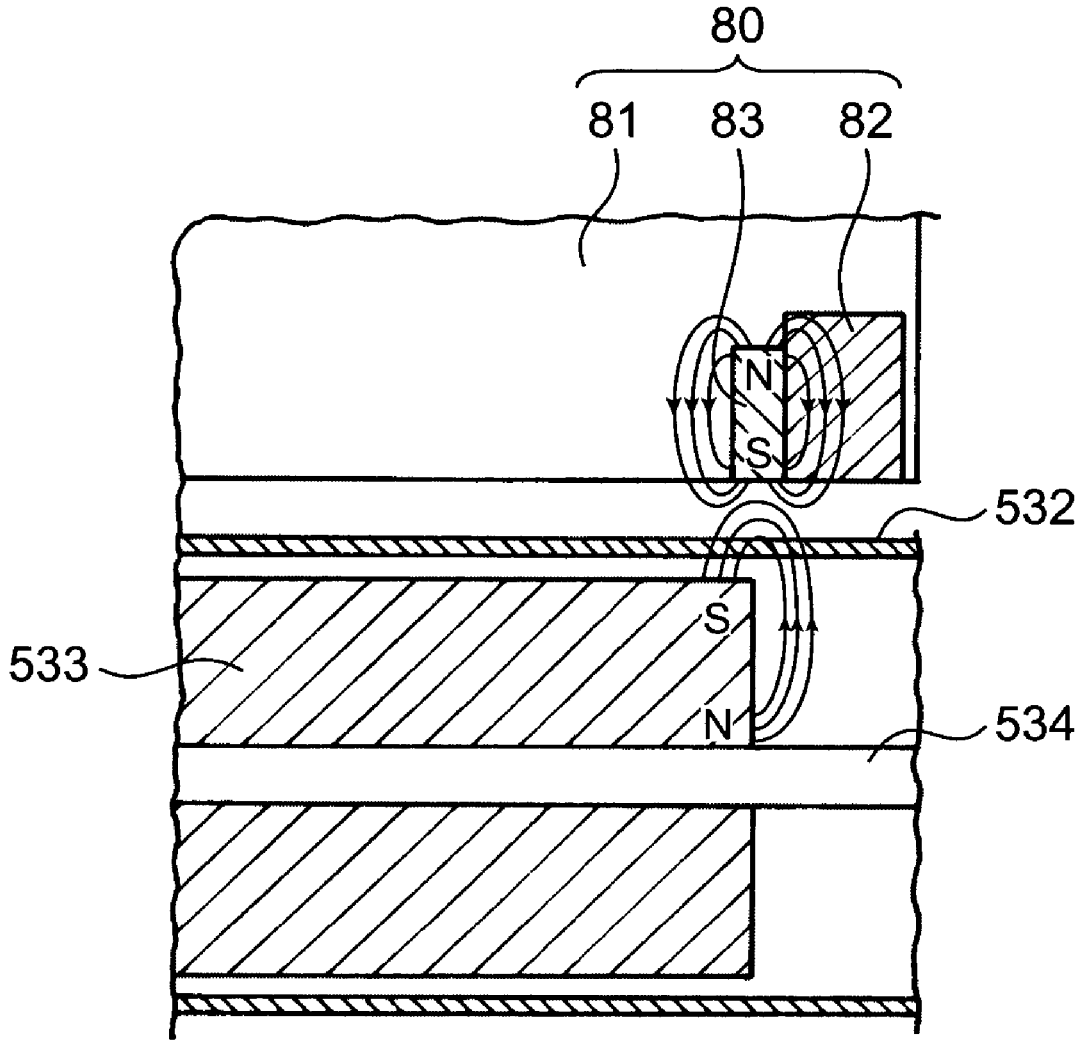
FIG. 9 is an explanatory diagram illustrating a function of the toner leakage preventing structure.

FIG. 9 is an explanatory diagram illustrating a function of the toner leakage preventing structure 80. As shown in FIG. 9, in the end portion of the sleeve main body 532, the sleeve magnet 533 interiorly disposed in the sleeve main body 532 and the magnetic member magnet 83 mounted in the blade 81 face each other in such a manner that the opposite facing portions have the same polarity. (The magnets face each other have the south polarity in FIG. 9.) Thus, in the sleeve magnet 533, the magnetic fluxes run from the north pole to the south pole. In the magnetic member magnet 83, the magnetic fluxes run from the north pole to the south pole. Accordingly, the both magnetic fluxes are repelled with each other in a space between the magnetic member magnet 83 and the sleeve main body 532.

In a space where the magnetic fluxes having the same polarity repel with each other (the repelling polarity is S in FIG. 9), a force for removing particles having a predetermined electric charge is formed. Accordingly, toner particles T positively charged are removed by the removing force caused by the magnetic fluxes so as to be assuredly prevented from moving to the end portion of the sleeve main body 532 from the peripheral surface of the sleeve main body 532, thereby being prevented from leaking from the developing sleeve 53.

However, in the case where a developer of the so-called magnetic one-component system is employed, magnetic particles are mixed in toner particles T. Accordingly, toner particles T are guided to be removed along with the magnetic particles removed due to the magnetic fluxes irrespective of whether toner particles are electrically charged or not.

As described above, the developing device 50 includes the developing sleeve 53 mounted in the predetermined casing 58 for supplying toner particles T to the latent image area 22 on the peripheral surface of the photoconductive drum 20 while rotating relatively about the central shaft 534, and the sleeve 53 has the immovable sleeve magnet 533 therein. The pair of magnetic members 82 are disposed in the opposite end portions of the developing sleeve 53 in such a manner as to have a predetermined distance to the peripheral surface of the developing sleeve. Each magnetic member has an arc shape. The magnetic member magnet 83 is mounted on the inner surface of the magnetic member 82 in such a manner that the opposite facing portions of the magnetic member magnet 83 and the sleeve magnet 533 have the same polarity.

With this construction, toner particles T in the casing 58 are guided to the peripheral surface of the developing sleeve 53 and fed toward the photoconductive drum 20 by the rotation of the developing sleeve 53 which is allowed to be rotated about the central shaft 534 with loading toner particles T in the casing 58. Thus, toner particles T are supplied to the latent image area 22 on the peripheral surface of the photoconductive drum 20 rotating about the shaft, and the toner image is formed. The toner image is transferred onto the sheet P synchronously fed in response to the rotation of the photoconductive drum 20.

Due to the rotation of the developing sleeve 53, toner particles T receive a component force by which toner particles T move toward a direction orthogonal to the feeding direction, and are moved to the both end portions of the developing sleeve 53. However, the magnetic member magnet 83 is mounted on an inner surface of the magnetic member 82 in such manner that the opposite facing portions of the magnetic member magnet 83 and the sleeve magnet 533 have the same polarity. Accordingly, the magnetic fluxes from one magnetic pole repel the magnetic fluxes from the other magnetic pole in the space between the magnetic member magnet 83 and the developing sleeve 53. Due to the magnetic fluxes repelling each other, toner particles T are prevented from passing through the space, thereby being assuredly prevented from leaking from the both end portion of the developing sleeve 53.

As mentioned above, the magnetic member magnet 83 is mounted on the pair of the magnetic member 82 in such a manner that the magnetic member magnet 83 and the sleeve magnet 533 face each other at the same polarity. Accordingly, toner particles T can be assuredly prevented from leaking from the both end portions of the developing sleeve 53 in comparison with the case as a conventional manner where the magnetic fluxes are bridged between the adjacent opposite poles of a plurality of magnet sections formed only on the magnetic member 82.

The blade 81 made of a magnetic material is provided at a predetermined gap against the peripheral surface of the developing sleeve 53, and adjusts the supply amount of toner particles T to the photoconductive drum 20. Accordingly, by rotating the developing sleeve 53 about the central shaft 534 in the state where toner particles T are put in the casing 58, toner particles T in the casing 58 are guided along the peripheral surface of the developing sleeve 53 toward the photoconductive drum 20. While the supply amount of toner particles T is adjusted by allowing toner particles T to pass through the space between the bottom edge of the blade 81 and the peripheral surface of the developing sleeve 53, toner particles T are supplied to the latent image area 22 of the peripheral surface of the photoconductive drum 20 rotating about the shaft, thereby forming a toner image.

The blade 81 is made of a magnetic material. The magnetic fluxes of the magnet in the developing sleeve 53 run across the gap between the blade 81 and the peripheral surface of the developing sleeve 53 and reach the magnetic members 82. At this time, the short magnetic fields occur in the gap, the short magnetic fields directing to the peripheral surface of the photoconductive drum 20. Accordingly, toner particles T are guided by the short magnetic fields and appropriately supplied to the peripheral surface of the photoconductive drum 20.

As mentioned above, the blade 81 made of a magnetic material is provided at a predetermined gap against the peripheral surface of the developing sleeve 53 to adjust the supply amount of toner particles T. Therefore, toner particles T are appropriately supplied from the developing sleeve 53 to the photoconductive drum 20. Further, due to the formed short magnetic fields, toner particles T are supplied to the peripheral surface of the photoconductive drum 20 effectively. Therefore, the amount of toner particles T moving to the both end portions of the sleeve 53 is reduced. Consequently, a favorite effect can be obtained for the toner leakage prevention from the both end portions of the developing sleeve 53.

The blade magnet 811*a* is mounted on the blade 81. Accordingly, the cross-linking of magnetic fluxes is stronger than the case having no blade magnet. Therefore, a stronger magnetic chain generates, which consequently moves toner particles T to the peripheral surface of the photoconductive drum 20 more properly.

The printer 10 employing the above mentioned developing device 50 enjoys the effect of effectively preventing such disadvantages as internal contamination by leaked toner particles T. The present invention is not limited to the foregoing embodiments, but the following modification may be made.

In the foregoing embodiment, the printer 10 is raised as an example of an image forming apparatus to which the developing device 50 is applied. However, the present invention is not limited to the printer 10 as the image forming apparatus, it may be a copying machine, a facsimile machine, or a scanner machine for reading image information and electrically transmitting the same to a computer.

The foregoing embodiment employs the blade 81 including the thin portion 811 and the thick portion 812. However, the present invention is not limited to the blade 81 including the thin portion 811 and the thick portion 812. A blade having a uniform thickness may be employed.

In the foregoing embodiment, the blade magnet 811*a* is mounted on the blade 81. However, the present invention is not limited to the mounting of the blade magnet 811*a* to the blade 81. No magnet may be required to be mounted.

In the foregoing embodiment, the space between the peripheral surface of the sleeve main body 532 and the inner surface of the magnetic member magnet 83 mounted on the magnetic member 82 is set at constant. However, the space may be gradually increased from an upstream to a downstream in the rotating direction of the developing sleeve 52 as an altered embodiment. With this construction, toner particles T which have been held by the increasing space are more easily released in the downstream end portion of the magnetic member 82 and the magnetic member magnet 83 than the case where the space is constant. Therefore, toner particles T can be released at a suppressed dispersion.

In the foregoing embodiment, the sleeve magnet 533 has a cylindrical shape. However, the present invention is not limited to the cylindrical sleeve magnet, but a sleeve magnet may be provided only at a portion opposite to the magnetic member magnet 83.

In the foregoing embodiment, toner particles T are supplied to the developing device 50 from the detachably mounted toner cartridge 59. In other words, the toner cartridge 59 is separated from the developing device 50. However, the present invention are not limited to the separation type that the developing device 50 and the toner cartridge 59 are separable, but may use a developing unit in which a toner cartridge 59 is integral with a casing 58 of a developing device 50. In such developing unit, a used developing unit is entirely replaced with a new developing unit when the toner particles run out.

This application is based on patent application No. 2005-138001 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A developing device comprising:

a predetermined casing structure;

a developing sleeve mounted in the casing for supplying toner particles to a latent image area on a peripheral surface of a photoconductive drum while rotating about an axis, the developing sleeve having an immovable sleeve magnet therein, the sleeve magnet including at least a first magnet unit and a second magnet unit, the first magnet unit and the second magnet unit are mounted so that portions of the first and second magnet units located close to the peripheral surface of the developing sleeve have opposite polarities to each other;

a pair of magnetic members being disposed in the opposite end portions of the developing sleeve and spaced away from the peripheral surface of the developing sleeve a predetermined distance, each of the magnetic members having an arc shape; and, a magnetic member magnet mounted in the magnetic member, the magnetic member magnet including a third magnet unit facing the first magnet unit and a fourth magnet unit facing the second magnet unit, the third magnet unit and the first magnet unit are mounted to have the same polarity at their opposite facing portion, while the fourth magnet unit and the second magnet unit are mounted to have the same polarity at their opposite facing portions, wherein the first, second, third and fourth magnet units have boundaries disposed so that the boundaries of the first and third magnet units substantially align with one another and so that the boundaries of the second and fourth magnet units substantially align with one another.

2. A developing device according to claim 1, further comprising a blade disposed over the peripheral surface of the developing sleeve with a predetermined space for adjusting the supply amount of toner particles to the photoconductive drum, the blade being made of a magnetic material.

3. A developing device according to claim 2, wherein the blade is provided with a blade magnet.

4. A developing device according to claim 2, wherein the blade includes a thin portion corresponding the latent image area of the photoconductive drum, a pair of thick portions on the opposite both ends of the thin portion, and a step portion in a boundary between the thin portion and the thick portion.

5. A developing device according to claim 1, wherein the magnetic member has an arc shape whose center angle is substantially 180°.

6. A developing device according to claim 1, wherein the magnetic member magnet has an arc shape, and has the common curvature center as the magnetic member.

7. A developing device according to claim 6, wherein the magnetic member magnet includes a plurality of magnet units each having the shape of a donut sector.

8. A developing device comprising:

a predetermined casing structure;

a developing sleeve mounted in the casing for supplying toner particles to a latent image area on a peripheral surface of a photoconductive drum while rotating about an axis, the developing sleeve having an immovable sleeve magnet therein;

a pair of magnetic members being disposed in the opposite end portions of the developing sleeve and spaced away from the peripheral surface of the developing sleeve a predetermined distance, each of the magnetic members having an arc shape;

a magnetic member magnet mounted in the magnetic member and facing the sleeve magnet in such a manner that the opposite facing portions of the magnetic member magnet and the sleeve magnet have the same polarity; and a blade disclosed over the peripheral surface of the developing sleeve with a predetermined space for adjusting the supply amount of toner particles to the photoconductive drum, the blade being made of a magnetic material and being provided with a blade magnet, the blade includes a thin portion facing the latent image area of the photoconductive drum, and a pair of thick portions on opposite ends of the thin portion, and the blade magnet is placed in a lower portion of the thin portion.

9. An image forming apparatus in which a toner image is formed by supplying toner particles onto a static latent image formed on a peripheral surface of a photoconductive drum, and the toner image is transferred onto a sheet, the image forming apparatus being provided with a developing device comprising:

a predetermined casing structure;

a developing sleeve mounted in the casing for supplying toner particles to a latent image area on a peripheral surface of a photoconductive drum while rotating about an axis, the developing sleeve having an immovable sleeve magnet therein, the sleeve magnet including at least a first magnet unit and a second magnet unit, the first magnet unit and the second magnet unit are mounted so that portions of the first and second magnet units located close to the peripheral surface of the developing sleeve have opposite polarities to each other;

a pair of magnetic members being disposed in the opposite end portions of the developing sleeve and spaced away from the peripheral surface of the developing sleeve a predetermined distance, each of the magnetic members having an arc shape; and, a magnetic member magnet mounted in the magnetic member, the magnetic member magnet including a third magnet unit facing the first magnet unit and a fourth magnet unit the facing second magnet unit, the third magnet unit and the first magnet unit are mounted to have the same polarity at their opposite facing portion, while the fourth magnet unit and the second magnet unit are mounted to have the same polarity at their opposite facing portion, wherein the first, second, third and fourth magnet units have boundaries disposed so that the boundaries of the first and third magnet units substantially align with one another and so that the boundaries of the second and fourth magnet units substantially align with one another.

10. An image forming apparatus according to claim 9, further comprising a blade disposed over the peripheral surface of the developing sleeve with a predetermined space for adjusting the supply amount of toner particles to the photoconductive drum, the blade being made of a magnetic material.

11. An image forming apparatus according to claim 10, wherein the blade is provided with a blade magnet.

12. An image forming apparatus according to claim 10, wherein the blade includes a thin portion corresponding the latent image area of the photoconductive drum, a pair of thick portions on the opposite both ends of the thin portion, and a step portion in a boundary between the thin portion and the thick portion.

13. An image forming apparatus according to claim 9, wherein the magnetic member has an arc shape whose center angle is substantially 180°.

14. An image forming apparatus according to claim 9, wherein the magnetic member magnet has an arc shape, and has the common curvature center as the magnetic member.

15. An image forming apparatus according to claim 14, wherein the magnetic member magnet includes a plurality of magnet units each having the shape of a donut sector.

16. An image forming apparatus in which a toner image is formed by supplying toner particles onto a static latent image formed on a peripheral surface of a photoconductive drum, and the toner image is transferred onto a sheet, the image forming apparatus being provided with a developing device comprising:

a predetermined casing structure;

a developing sleeve mounted in the casing for supplying toner particles to a latent image area on a peripheral surface of a photoconductive drum while rotating about an axis, the developing sleeve having an immovable sleeve magnet therein;

a pair of magnetic members being disposed in the opposite end portions of the developing sleeve and spaced away from the peripheral surface of the developing sleeve a predetermined distance, each of the magnetic members having an arc shape;

a magnetic member magnet mounted in the magnetic member and facing the sleeve magnet in such a manner that the opposite facing portions of the magnetic member magnet and the sleeve magnet have the same polarity; and a blade disclosed over the peripheral surface of the developing sleeve with a predetermined space for adjusting the supply amount of toner particles to the photoconductive drum, the blade being made of a magnetic material and being provided with a blade magnet, the blade includes a thin portion facing the latent image area of the photoconductive drum, and a pair of thick portions on opposite ends of the thin portion, and the blade magnet is placed in a lower portion of the thin portion.

* * * * *